US005532810A

United States Patent [19]

Cahill

[11] Patent Number: 5,532,810

[45] Date of Patent: Jul. 2, 1996

[54] FUSER ROLLER SKIVE MECHANISM HAVING ANTI-GOUGING SKIVE FINGERS

[75] Inventor: David F. Cahill, Rochester, N.Y.

[73] Assignee: Eastman Kodak Company, Rochester, N.Y.

[21] Appl. No.: 335,933

[22] Filed: Nov. 8, 1994

[51] Int. Cl.[6] ..... G03G 21/00

[52] U.S. Cl. ..... 355/315; 271/307

[58] Field of Search ..... 355/315; 271/307

[56] References Cited

U.S. PATENT DOCUMENTS

| | | | |
|---|---|---|---|
| 3,846,151 | 11/1974 | Roteman et al. | 117/21 |
| 3,973,844 | 8/1976 | McCarroll | 355/3 R |
| 3,986,227 | 10/1976 | Fathergill et al. | 15/256.53 |
| 3,992,000 | 11/1976 | Martin . | |
| 4,065,120 | 12/1977 | Imaizumi et al. . | |
| 4,149,797 | 4/1979 | Imperial | 355/3 FU |
| 4,165,965 | 8/1979 | Bernardelli et al. | 432/75 |
| 4,357,094 | 11/1982 | Zepko | 355/3 FU |
| 4,384,781 | 5/1983 | Takada | 355/3 FU |
| 4,408,757 | 10/1983 | Yarm | 271/311 |
| 4,421,401 | 12/1983 | Kagiura et al. | 355/3 FU |
| 4,475,804 | 10/1984 | Kanno et al. | 355/3 FU |
| 4,571,054 | 2/1986 | Bowler, Jr. | 355/3 SH |
| 4,571,056 | 2/1986 | Tani et al. | 355/3 FU |
| 4,737,818 | 4/1988 | Tanaka et al. | 355/14 FU |
| 4,755,848 | 7/1988 | Tamary | 355/3 FU |
| 5,047,809 | 9/1991 | Owada et al. | 355/284 |
| 5,053,830 | 10/1991 | Arai | 355/315 X |
| 5,136,337 | 8/1992 | Baruch | 355/290 |

*Primary Examiner*—Fred L. Braun
*Attorney, Agent, or Firm*—Lawrence P. Kessler

[57] ABSTRACT

A fuser assembly having a pair of rollers in nip relation to transport a receiver member therebetween to permanently fix a marking particle image to such receiver member, and at least one skive mechanism for stripping a receiver member adhering to a fuser assembly roller from the said roller. The skive mechanism includes at least one elongated, relatively flexible skive finger. A major portion of the skive finger is supported by a support body so as to increase the rigidity thereof. The skive finger support body is mounted on an elongated shaft having a longitudinal axis substantially parallel to the longitudinal axis of a fuser assembly roller. The longitudinal axes are spaced apart a predetermined fixed distance less than the sum of the longitudinal dimension of the support body for the skive finger and the radius of the fuser assembly roller. As such in a first position the skive finger engages the roller with the skive finger support spaced from the roller, and in a second position the skive finger engages the roller with the skive finger support in engagement with the roller to limit flexing of the skive finger to substantially prevent gouging of the peripheral surface of the fuser assembly roller or damage to the skive finger.

7 Claims, 4 Drawing Sheets

FUSER ROLLER SKIVE MECHANISM HAVING ANTI-GOUGING SKIVE FINGERS

RELATED APPLICATION

U.S. patent application Ser. No. 08/335,927, filed Nov. 8, 1994, in the name of David F. Cahill.

BACKGROUND OF THE INVENTION

The present invention relates in general to a skive mechanism for stripping receiver members from fuser assembly rollers of reproduction apparatus, and more particularly to a fuser assembly roller skive mechanism which will substantially prevent damage to the skive fingers of the skive mechanism, or gouging of the surface of the rollers by the skive fingers.

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser assembly at a downstream location. There the image is fixed to the receiver member by heat and/or pressure from the fuser assembly to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

It sometimes happens that the marking particles stick to the peripheral surface of the heated roller and result in the receiver member adhering to such roller; or the marking particles may stick to the heated roller and subsequently transfer to the peripheral surface of the pressure roller resulting in the receiver member adhering to the pressure roller. Therefore, a skive mechanism including skive fingers (or separator pawls) have been employed to engage the respective peripheral surfaces of the fuser assembly rollers to strip any adhering receiver member from the rollers in order to substantially prevent receiver member jams in the fuser assembly.

Typically a fuser assembly skive mechanism includes a plurality of skive fingers. The skive fingers are generally formed as elongated members respectively having a relatively sharp leading edge urged into engagement with a fuser assembly roller. For example, the skive fingers may be thin, relatively flexible, metal shim stock. The respective leading edge of each of the skive fingers is directed, in the opposite direction to rotation of the fuser assembly roller with which such skive finger is associated, so as to act like a chisel to strip any receiver member adhering to such roller from the peripheral surface thereof. However, if the marking particle image is particularly heavy, the receiver member may adhere to a fuser assembly roller with such force that engagement with the skive fingers does not completely strip the receiver member from the roller.

When a receiver member transported through the fuser assembly is only stripped from a roller by some of the skive fingers (and not by others), the receiver member will cause a jam in the fuser assembly. This destroys the reproduction formed on the receiver member and shuts down the reproduction apparatus. Moreover, as the receiver member moves with the fuser assembly roller to which it adheres, the stripped portions of the receiver member are forced into engagement with their associated skive fingers by the non-stripped portions of the receiver member. The engagement force of the receiver member on the skive fingers may be sufficient to flex those skive fingers so as to engage the associated peripheral surface of the fuser assembly roller at a substantially increased attack angle. This increased attack angle may then damage the roller by gouging its peripheral surface or may damage the skive finger itself. Alternatively, as the receiver member is transported through the fuser assembly, the receiver member may apply such force to the skive fingers on initial engagement therewith so as to cause such fingers to buckle in the direction which will flex those skive fingers to engage the associated fuser assembly roller at an increased attack angle. Again, this increased attack angle may damage the roller by gouging its peripheral surface or may damage the skive finger itself.

SUMMARY OF THE INVENTION

In view of the foregoing discussion, this invention is directed to a fuser assembly having a pair of rollers in nip relation to transport a receiver member therebetween to permanently fix a marking particle image to such receiver member, and at least one skive mechanism for stripping a receiver member adhering to a fuser assembly roller from the roller. The skive mechanism includes at least one elongated, relatively flexible skive finger. A major portion of the skive finger is supported by a support body so as to increase the rigidity thereof. The skive finger support body is mounted on an elongated shaft having a longitudinal axis substantially parallel to the longitudinal axis of a fuser assembly roller. The longitudinal axes are spaced apart a predetermined fixed distance less than the sum of the longitudinal dimension of the support body for the skive finger and the radius of the fuser assembly roller. As such, in a first position the skive finger engages the roller with the skive finger support spaced from the roller, and in a second position the skive finger engages the roller with the skive finger support in engagement with the roller to limit flexing of the skive finger to substantially prevent gouging of the peripheral surface of the fuser assembly roller or damage to the skive finger.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
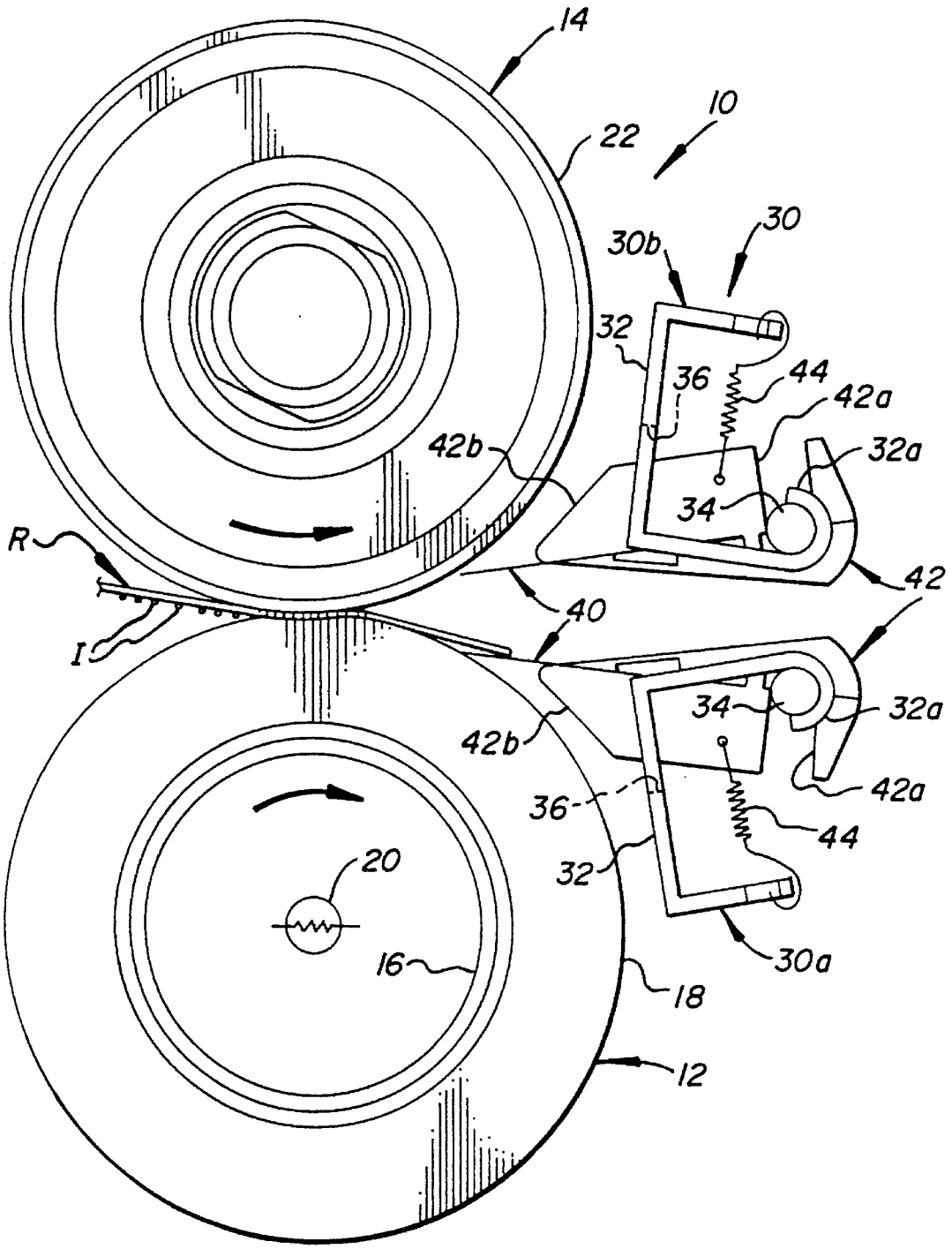
FIG. 1 is a front elevational view, partly in cross-section with portions removed to facilitate viewing, of a typical fuser assembly for a reproduction apparatus, incorporating the anti-gouging skive mechanism according to this invention, showing the skive fingers of the skive mechanism in their normal operating position.

Referring now to the accompanying drawings, FIG. 1 shows a typical fuser assembly, for a reproduction apparatus of the electrostatographic type, designated generally by the numeral 10. The fuser assembly 10 includes a fuser roller 12 in nip relation with a pressure roller 14. Rotation of the fuser assembly rollers by any suitable drive mechanism (not shown) will serve to transport a receiver member (designated by the letter R in FIG. 1), bearing a marking particle image (designated by the letter I in FIG. 1) through the nip under the application of heat and pressure. The receiver member may be, for example, a sheet of plain bond paper, or transparency material. The heat will plastisize the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12.

The pressure roller 14 has a hard outer shell 22. Typically, the shell 22 is made of metal, such as aluminum or steel for example. The shell 22 may also have a well known suitable surface coating (not shown) applied thereto to substantially prevent offsetting of the marking particle image to the pressure roller 14. A cleaning assembly (not shown) may be provided to remove residual marking particle, paper fibers, and dust from the fuser assembly rollers.

As noted above, under certain circumstances, such as when fusing heavy marking particle images, the receiver member may adhere to one or the other of the fuser assembly rollers (i.e., fuser roller 12 or pressure roller 14). Therefore, a skive mechanism designated generally by the numeral 30 is provided according to this invention. The skive mechanism 30 includes a pair of assemblies 30*a* and 30*b* respectively associated with the fuser assembly rollers 12 and 14. Since the assemblies 30*a*, 30*b* are essentially mirror images of one another, only assembly 30*a*, and its function relative to the fuser roller 12, will be fully described. It is of course clearly understood that the other assembly 30*b* is of substantially the same (but mirrored) construction, and functions in the same manner relative to the pressure roller 14.

Figure 2:
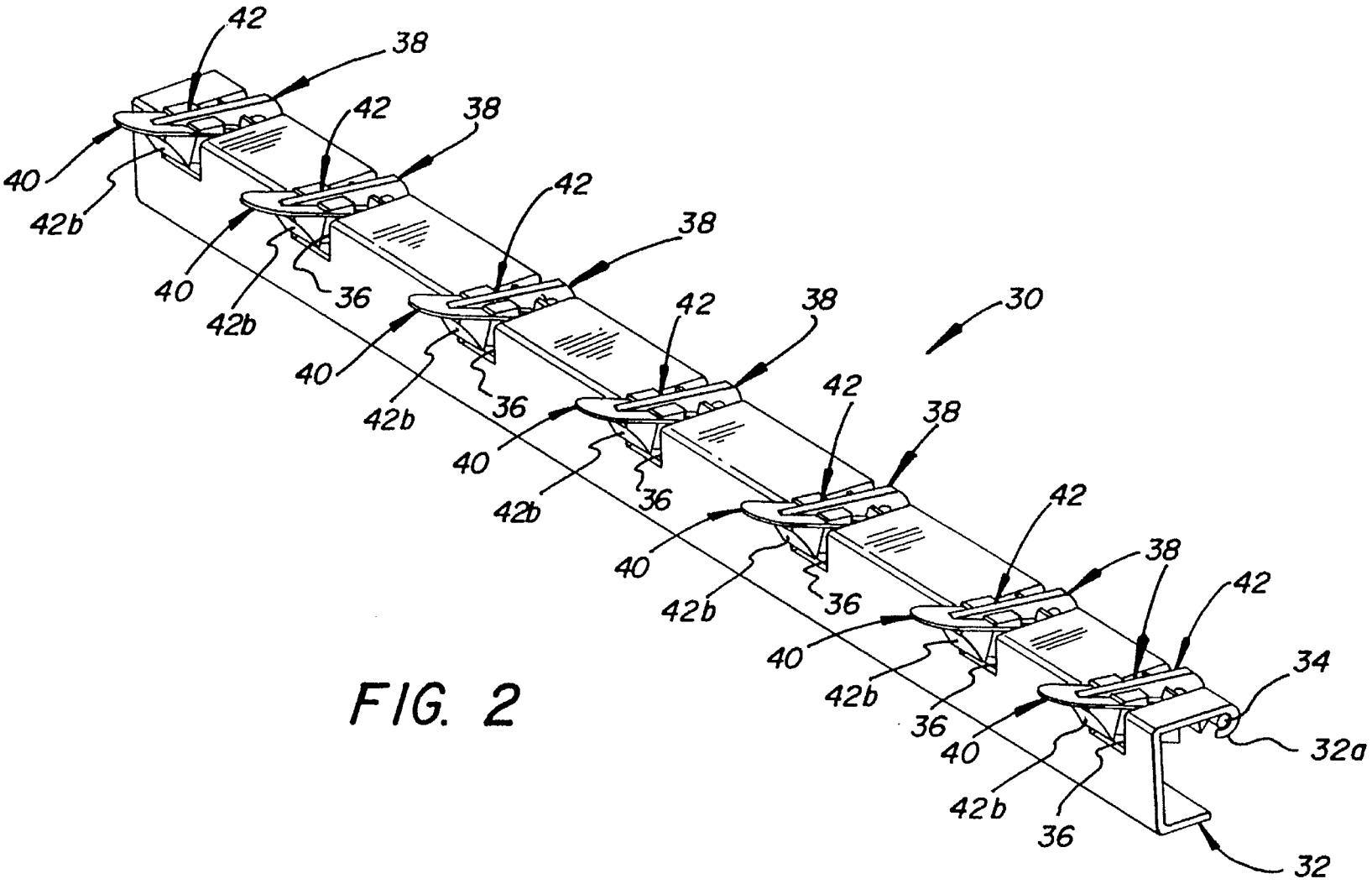
FIG. 2 is a view in perspective of an assembly for a plurality of skive members for the anti-gouging skive mechanism for use in the fuser assembly of FIG. 1.

The assembly 30*a* of the skive mechanism 30 comprises a mounting bracket 32 (best shown in FIGS. 1 and 2). The bracket 32 is supported within the frame of a reproduction apparatus, in any well known suitable manner, in a predetermined spatial relation with the fuser roller 12. The bracket has a turned marginal edge portion 32*a* which captures and supports a shaft 34. The shaft 34 extends for substantially the full longitudinal dimension of the bracket 32, and is retained such that its longitudinal axis is substantially parallel to the longitudinal axis of the fuser roller 12. Further, the bracket 32 defines a plurality of openings 36. The openings 36 are substantially uniformly spaced along the longitudinal dimension of the bracket 32.

Figure 3:
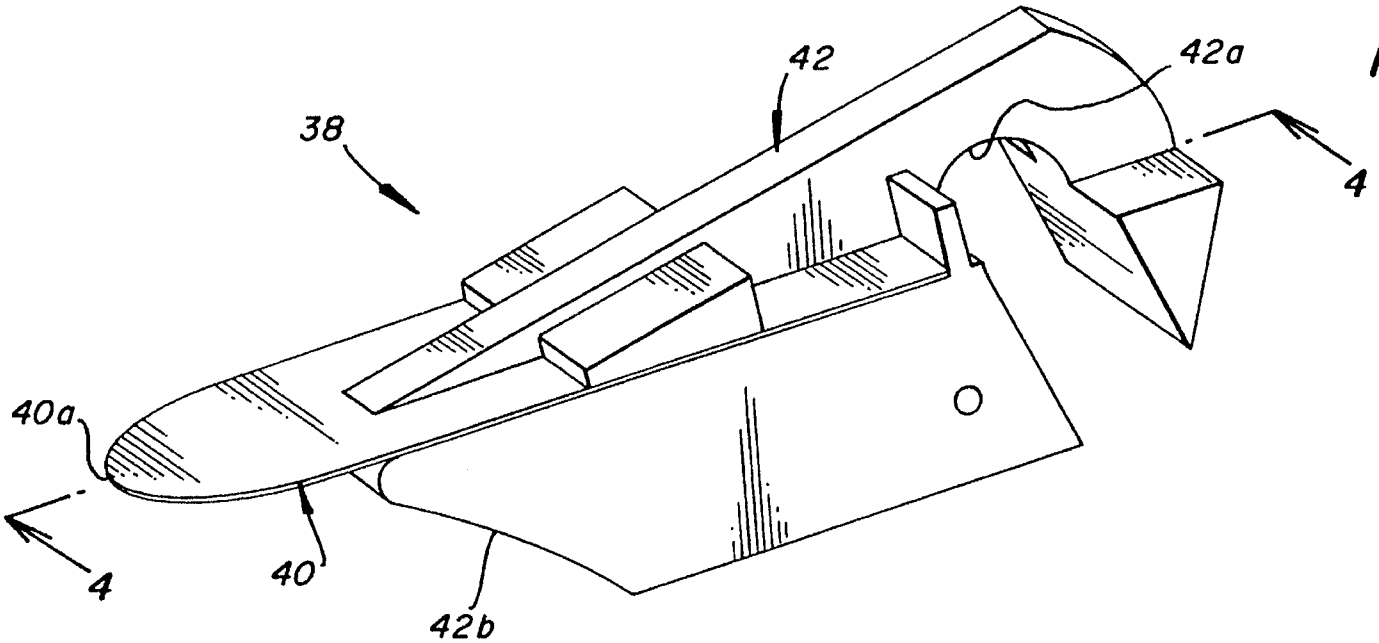
FIG. 3 is a view in perspective, on an enlarged scale, of a skive member for the anti-gouging skive mechanism according to this invention.
Figure 4:
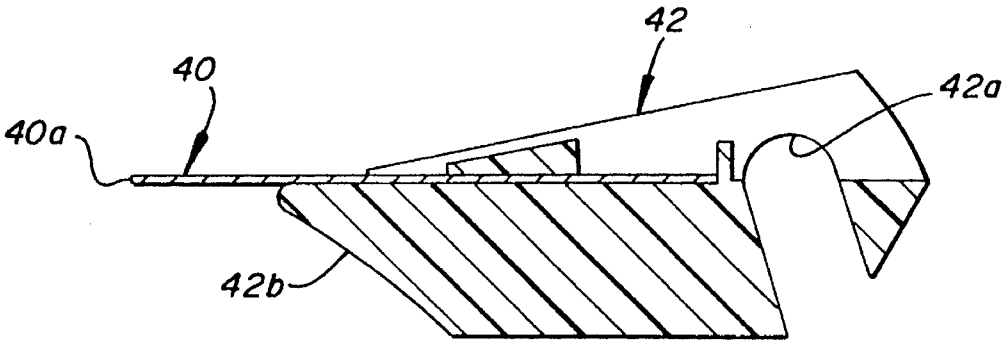
FIG. 4 is a side elevational view, in cross-section, taken along lines 4—4 of FIG. 3, of a skive member for the anti-gouging skive mechanism for use in the fuser assembly of FIG. 1.

A plurality of skive members 38 are associated with the plurality of openings respectively (see FIG. 2). Each of the skive members 38 (best shown in FIGS. 3 and 4) comprises a skive finger 40 and a skive finger support 42. The skive finger 40 is formed as an elongated, relatively flexible element having a sharp chisel-like lead edge 40*a*. For example, the skive finger 40 may typically be made from a thin metal sheet. Of course, other strong, relatively flexible materials such as some plastic formulations are suitable for use with this invention.

The skive finger support 42 is formed as a main body portion of molded plastic for example. The main body portion of the skive finger support 42 captures a major segment of the skive finger 40 with the lead edge 40*a* extending beyond the main body portion. In this manner, the free portion of the skive finger 40 (that is, the portion of the finger which is able to flex) is significantly shortened. Consequently, the overall rigidity of the finger 40 is increased. Further, the main body portion of the skive finger support 42 defines a slot 42*a* and a lead edge 42*b*. The slot 42*a* is adapted to be received on the shaft 34. Accordingly, each of the skive finger supports 42, and thus the respective skive fingers 40, is mounted on the shaft 34, to extend through an associated opening 36 in the bracket 32.

The longitudinal dimension of the main body portion of the skive finger supports 42 is preselected to normally locate the lead edge 40*a* of the respective skive fingers 40 in contact with the peripheral surface of the fuser roller 12 and the lead edge 42*a* of the respective supports 42 in spaced relation with the fuser roller (see FIG. 1). A tension spring 44 is connected between the main body portion of each of the skive finger supports 42 and the mounting bracket 32. The tension springs respectively urge the skive fingers 40 into engagement with the peripheral surface of the fuser roller 12 with sufficient force to establish a low attack angle whereby a receiver member adhering to such roller will normally be stripped from the roller.

Figure 5:
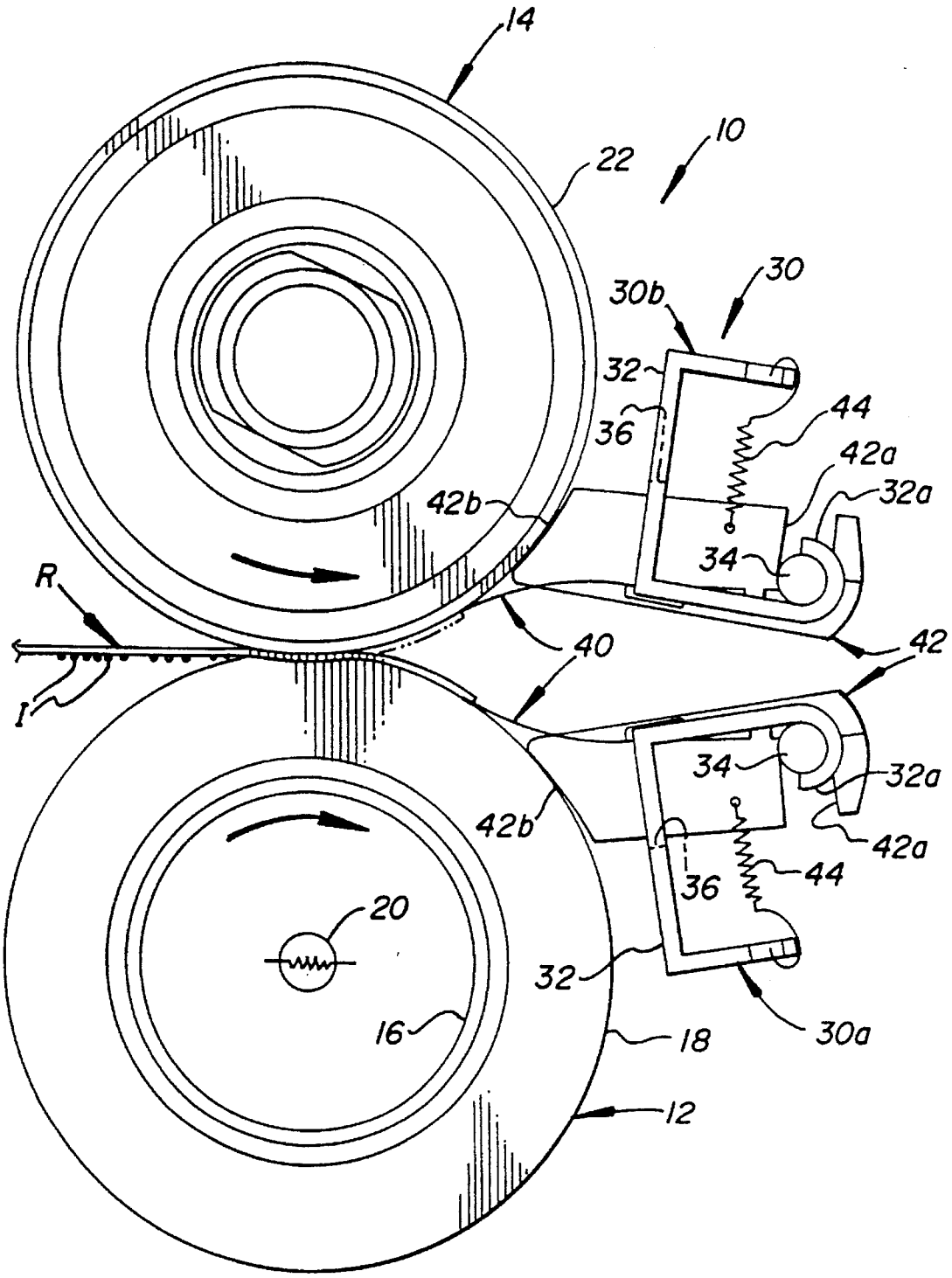
FIG. 5 is a front elevational view, similar to FIG. 1, of a typical fuser assembly for a reproduction apparatus, incorporating anti-gouging skive mechanism according to this invention, showing the skive fingers when subjected to a receiver member adhering to a fuser assembly roller.

However, when the receiver member adheres to the fuser roller surface with sufficient force to overcome the stripping force of at least some of the skive fingers 40 of the skive mechanism 30, the skive fingers will be urged in a direction which pivots the associated skive finger supports 42 in a counter-clock wise direction (when viewed in the direction of FIG. 1). The preselected longitudinal dimension of the main body portion of the skive finger support 42, and the preselected location of the bracket 32 relative to the fuser roller 12, is such that after a limited degree of pivotal movement, the lead edge 42*a* of the main body portion will contact the peripheral surface of the fuser roller (see FIG. 5). That is, the axes of the shaft 34 and the roller 12 are spaced apart a distance less than the sum of the longitudinal dimension of the main body portion of the skive finger support 42 and the radius of the roller 12.

Due to the material from which the main body portion of the skive member support 42 is formed and the particular shape of the lead edge 42*a* thereof, contact of the main body portion lead edge with the fuser roller 12 will not damage the fuser roller peripheral surface. Additionally, limiting the pivotal movement of the skive members 38 prevents the skive fingers 40 from flexing to a degree which would cause the fingers to buckle and thereby assume a high attack angle with the fuser roller surface. Since a high attack angle represents a condition where gouging of the peripheral surface of the fuser roller (or damage to the skive fingers) occurs, it is clear that the particular construction of the skive mechanism 30 substantially prevents the fuser roller surface gouging, or skive finger damaging, condition to exist.

The invention has been described in detail with particular reference to preferred embodiment thereof, but it will be understood that variations and modifications can be effected within the spirit and scope of the invention as set forth in the claims.

What is claimed is:

1. In a fuser assembly having a pair of rollers and in nip relation to transport a receiver member therebetween to permanently fix a marking particle image to such receiver member, at least one skive mechanism for stripping a receiver member adhering to a fuser assembly roller from said roller, said skive mechanism comprising:

at least one elongated, relatively flexible skive finger;

means, associated with said at least one skive finger, having a body portion for supporting a major portion of said skive finger so as to increase the rigidity thereof;

an elongated shaft having a longitudinal axis, said longitudinal axis of said elongated shaft being substantially parallel with the longitudinal axis of a roller of said fuser assembly, said axes spaced apart a predetermined fixed distance less than the sum of the longitudinal dimension of said body portion of said skive finger supporting means and the radius of said fuser assembly roller; and said skive finger support means mounted on said elongated shaft for movement about said longitudinal axis of said elongated shaft to a first position where said at least one skive finger engages said roller with said skive finger supporting means spaced from said roller, or a second position where said at least one skive finger engages said roller with said skive finger supporting means in engagement with said roller to limit flexing of said skive finger to substantially prevent gouging of the peripheral surface of the fuser assembly roller or damage to said skive finger.

2. The skive mechanism according to claim 1 including a plurality of skive fingers.

3. The skive mechanism according to claim 2 wherein said skive finger supporting means includes a plurality of body portions adapted to receive said plurality of skive fingers respectively, said plurality of body portions being pivotably supported at spaced intervals along the longitudinal axis of said shaft.

4. The skive mechanism according to claim 3 further including resilient means for urging said skive finger supporting means from said first position toward said second position.

5. The skive mechanism according to claim 4 wherein said resilient means for urging said skive finger supporting means from said first position toward said second position includes a plurality of springs connected to said plurality of body portions respectively.

6. A fuser assembly for a reproduction apparatus, said fuser assembly comprising:

a heated fuser roller;

a pressure roller in nip relation said heated fuser roller;

a skive mechanism for skiving a receiver member from said fuser assembly rollers, said skive mechanism including (a) a plurality of elongated skive fingers of relatively flexible construction respectively having a chisel-like lead edge; (b) a plurality of supports having body portions associated with said plurality of skive fingers respectively to hold a major portion of each of said skive fingers so as to increase the rigidity thereof; (c) a pair of elongated shafts respectively having a longitudinal axis, said longitudinal axis of said elongated shafts being respectively substantially parallel with the longitudinal axis of a roller of said fuser assembly, said axes spaced apart a predetermined fixed distance less than the sum of the longitudinal dimension of said body portion of said skive finger support and the radius of said fuser assembly roller; and (d) means for mounting said skive finger support bodies on said elongated shafts respectively for movement about said longitudinal axes of said elongated shafts to a first position where said skive fingers respectively engage said fuser assembly rollers with said skive finger support bodies spaced from said rollers, or a second position where said skive fingers respectively engage said rollers with said skive finger support bodies in engagement with said rollers to limit flexing of said skive fingers to substantially prevent gouging of the peripheral surface of the fuser assembly rollers or damage to said skive fingers.

7. The skive mechanism according to claim 6 further including a plurality of springs connected to said plurality of body portions respectively for urging said respective skive finger support body portions from said first position toward said second position.

* * * * *